US009506679B2

(12) United States Patent
Lee et al.

(10) Patent No.: US 9,506,679 B2
(45) Date of Patent: Nov. 29, 2016

(54) HEAT PUMP SYSTEM

(71) Applicant: KOREA INSTITUTE OF ENERGY RESEARCH, Daejeon (KR)

(72) Inventors: Gil Bong Lee, Daejeon (KR); Young Soo Lee, Daejeon (KR); Min Sung Kim, Daejeon (KR); Ki Chang Chang, Daejeon (KR); Jun Hyun Cho, Seoul (KR); Ho Sang Ra, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 346 days.

(21) Appl. No.: 14/324,324

(22) Filed: Jul. 7, 2014

(65) Prior Publication Data

US 2015/0114023 A1 Apr. 30, 2015

(30) Foreign Application Priority Data

Oct. 29, 2013 (KR) ..... 10-2013-0129228

(51) Int. Cl.

| | |
|---|---|
| ***F25B 13/00*** | (2006.01) |
| ***F25B 41/00*** | (2006.01) |
| ***F25B 47/00*** | (2006.01) |
| ***F25B 39/02*** | (2006.01) |
| ***F25D 21/00*** | (2006.01) |
| ***F25B 47/02*** | (2006.01) |
| ***F25B 41/04*** | (2006.01) |
| ***F25B 49/02*** | (2006.01) |

(52) U.S. Cl.

CPC ..... *F25B 47/025* (2013.01); *F25B 41/043* (2013.01); *F25B 41/046* (2013.01); *F25B 47/02* (2013.01); *F25B 49/02* (2013.01); *F25B 2347/021* (2013.01); *F25B 2600/2507* (2013.01)

(58) Field of Classification Search

CPC .... F25B 41/04; F25B 41/043; F25B 41/046; F25B 47/02; F25B 47/025; F25B 49/02; F25B 2347/021; F25B 2600/2507

USPC ..... 62/324.1, 498, 80, 81, 277, 278, 504, 62/524, 525

See application file for complete search history.

(56) References Cited

U.S. PATENT DOCUMENTS

| | | | | |
|---|---|---|---|---|
| 3,427,819 A * | 2/1969 | Seghetti | F25B 5/02 | 62/196.4 |
| 6,370,908 B1 * | 4/2002 | James | F25B 5/02 | 165/104.11 |
| 2006/0042310 A1 * | 3/2006 | Son | F25B 39/022 | 62/513 |

(Continued)

FOREIGN PATENT DOCUMENTS

| | | | |
|---|---|---|---|
| JP | 2012013363 A | * | 1/2012 |
| KR | 10-2003-0044452 A | | 6/2003 |

OTHER PUBLICATIONS

JP2012013363 Machine Translation.*

*Primary Examiner* — Ryan J Walters
*Assistant Examiner* — Joesph Trpisovsky
(74) *Attorney, Agent, or Firm* — Paratus Law Group, PLLC

(57) ABSTRACT

In a heat pump system according to the present invention, at least part of a plurality of outdoor heat-exchanging flow paths that pass through an outdoor heat exchanger is alternately selected as a flow path for defrosting and is used, and the other flow path is used as a flow path for evaporation so that defrosting and a heating operation can be simultaneously performed. In addition, the refrigerant in which a defrosting action is performed, while passing through the outdoor heat exchanger, is throttled and then is used for an evaporation action so that the structure of the heat pump system is simple and both heating and defrosting can be performed.

10 Claims, 19 Drawing Sheets

(56) References Cited

U.S. PATENT DOCUMENTS

2007/0137238 A1* 6/2007 Hu ..... F25B 5/02 62/277

2010/0175400 A1* 7/2010 Kasahara ..... F25B 1/10 62/225

2013/0145785 A1* 6/2013 Nobuhiro ..... F25B 49/02 62/160

* cited by examiner

HEAT PUMP SYSTEM

CROSS-REFERENCE TO RELATED PATENT APPLICATIONS

This application claims the benefit of Korean Patent Application No. 10-2013-0129228, filed on Oct. 29, 2013, in the Korean Intellectual Property Office, the disclosure of which is incorporated herein in its entirety by reference.

BACKGROUND OF THE INVENTION

1. Field of the Invention

The present invention relates to a heat pump system, and more particularly, to a heat pump system that is capable of removing frost formed on an outdoor heat exchanger while maintaining a heating operation.

2. Description of the Related Art

In general, a heat pump is a device for heating or cooling an indoor space by sequentially performing operations of compressing, condensing, expanding, and evaporating a refrigerant.

In the conventional heat pump, when a heating operation is performed in winter, an outdoor temperature is low such that frost is formed on the surface of an outdoor heat exchanger. In order to remove frost formed on the surface of the outdoor heat exchanger, the heating operation stops being performed for a moment, and a defrosting operation is performed for a predetermined amount of time. In the defrosting operation, a 4way valve is switched to change a flow of the refrigerant like in a cooling operation. A high-temperature refrigerant vapor discharged from the compressor flows into the outdoor heat exchanger, is used to melt and remove frost formed on the outdoor heat exchanger.

However, when the heating operation is temporarily switched to a cooling operation so as to perform the defrosting operation in winter, cold wind is blown indoors, which gives an unpleasant feeling to a user.

When an additional defrosting device is installed so as to perform the defrosting operation, a structure of the heat pump is complicated, and the size of the outdoor heat exchanger is increased.

Korean Patent Publication No. 2003-0044452 discloses a defrosting device for a heat pump type air conditioner.

SUMMARY OF THE INVENTION

The present invention provides a heat pump system that is capable of defrosting while performing a heating operation.

According to an aspect of the present invention, there is provided a heat pump system including: a compressor; an indoor heat exchanger; an outdoor heat exchanger; a plurality of outdoor heat-exchanging flow paths that are formed to pass through the outdoor heat exchanger and that heat-exchange a refrigerant flowing into the outdoor heat exchanger with outdoor air; and a flow path selection unit that alternately selects at least part of the plurality of outdoor heat-exchanging flow paths as a flow path for defrosting and supplies the refrigerant condensed by the indoor heat exchanger to the flow path for defrosting so that a defrosting action is capable of being performed and that selects the other flow path than the flow path for defrosting as a flow path for evaporation and that throttles the refrigerant discharged after the defrosting action is performed and then supplies the throttled refrigerant to the flow path for evaporation so that an evaporation action is capable of being performed.

According to another aspect of the present invention, there is provided a heat pump system including: a compressor; an indoor heat exchanger; an outdoor heat exchanger; a plurality of outdoor heat-exchanging flow paths that are formed to pass through the outdoor heat exchanger and that heat-exchange a refrigerant flowing into the outdoor heat exchanger with outdoor air; a suction valve for defrosting that is rotatably installed between an outlet of the indoor heat exchanger and an inlet of the outdoor heat exchanger, selects a flow path for defrosting of the plurality of outdoor heat-exchanging flow paths according to a rotation angle and supplies the refrigerant condensed by the indoor heat exchanger to the flow path for defrosting; a suction valve for evaporation that is rotatably installed on a flow path on which the outlet of the outdoor heat exchanger and the inlet of the outdoor heat exchanger are connected to each other, selects the other flow path than the flow path for defrosting of the outdoor heat-exchanging flow paths as a flow path for evaporation, throttles the refrigerant discharged after a defrosting action is performed on the outdoor heat exchanger and then supplies the throttled refrigerant; a discharge valve for defrosting that is rotatably installed on a flow path on which the outlet of the outdoor heat exchanger and the inlet of the suction valve for evaporation are connected to each other, and that supplies the refrigerant discharged on the flow path for defrosting of the outdoor heat-exchanging flow paths to the suction valve for evaporation according to a rotation angle; a discharge valve for evaporation that is rotatably installed on a flow path on which the outlet of the outdoor heat exchanger and the inlet of the compressor are connected to each other, and that supplies the refrigerant discharged on the flow path for evaporation from the outdoor heat-exchanging flow paths to the compressor according to a rotation angle; and a rotation unit that rotates the suction valve for defrosting, the suction valve for evaporation, the discharge valve for defrosting and the discharge valve for evaporation.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, a heat pump system according to embodiments of the present invention will be described with reference to the accompanying drawings.

Figure 1:
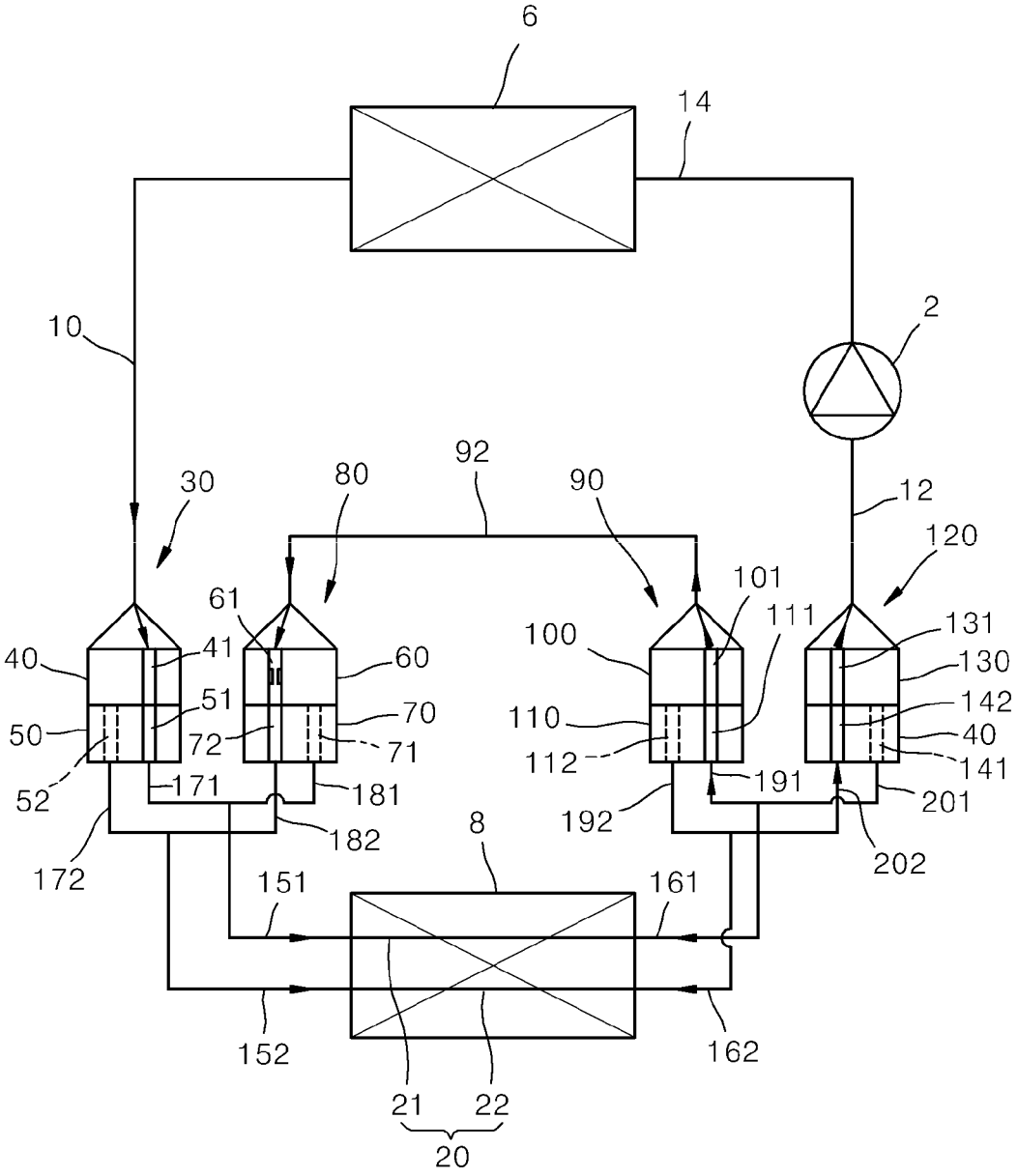
FIG. 1 is a view for describing a configuration of a flow of a refrigerant when a defrosting action is performed on a first outdoor heat-exchanging flow path of a heat pump system according to an embodiment of the present invention.

FIG. 1 is a view for describing a configuration of a flow of a refrigerant when a defrosting action is performed on a first outdoor heat-exchanging flow path of a heat pump system according to an embodiment of the present invention.

Referring to FIG. 1, the heat pump system according to an embodiment of the present invention includes a compressor 2, an indoor heat exchanger 6, an outdoor heat exchanger 8, outdoor heat-exchanging flow paths 20, and a flow path selection unit.

The indoor heat exchanger 6 and the compressor 2 are connected to each other via a first refrigerant flow path 14. The indoor heat exchanger 6 and the outdoor heat exchanger 8 are connected to each other via a second refrigerant flow path 10.

The outdoor heat exchanger 8 and the compressor 2 are connected to each other via a third refrigerant flow path 12.

The outdoor heat-exchanging flow paths 20 are flow paths in which a plurality of outdoor heat-exchanging flow paths are disposed in parallel so as to pass through the outdoor heat exchanger 8 and a refrigerant that flows into the outdoor heat exchanger 8 is heat-exchanged with outdoor air. In the current embodiment, the plurality of outdoor heat-exchanging flow paths 20 include two, i.e., first and second outdoor heat-exchanging flow paths 21 and 22. However, embodiments of the present invention are not limited thereto, and the plurality of outdoor heat-exchanging flow paths 20 may include two or more outdoor heat-exchanging flow paths. The number of outdoor heat-exchanging flow paths 20 is set to be the same as the number of suction fixing ports for defrosting, the number of suction fixing ports for evaporation, the number of discharge fixing ports for defrosting, and the number of discharge fixing ports for evaporation.

First and second heat-exchanging suction flow paths 151 and 152 are connected to a suction side of the outdoor heat exchanger 8, and first and second heat-exchanging discharge flow paths 161 and 162 are connected to a discharge side of the outdoor heat exchanger 8.

The flow path selection unit selects at least part of the plurality of outdoor heat-exchanging flow paths 20 as a flow path for defrosting and selects the other flow path than the flow path for defrosting as a flow path for evaporation. The flow path selection unit includes a suction valve 30 for defrosting, a suction valve 80 for evaporation, a discharge valve 90 for defrosting, and a discharge valve 120 for evaporation.

The suction valve 30 for defrosting is rotatably installed at the suction side of the outdoor heat exchanger 8. The suction valve 30 for defrosting is rotatably installed on a flow path on which the outlet of the indoor heat exchanger 6 and the inlet of the outdoor heat exchanger 8 are connected to each other.

Figure 2:
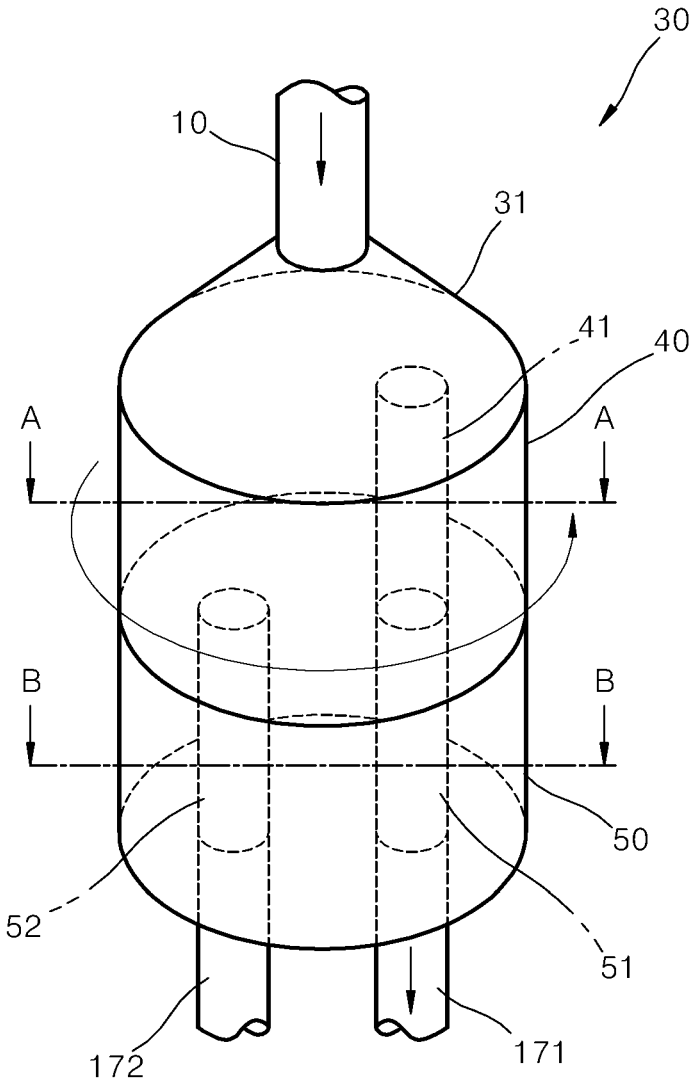
FIG. 2 is a view for describing a suction valve for defrosting illustrated in FIG. 1.

Referring to FIG. 2, the suction valve 30 for defrosting includes a suction fixing portion 50 for defrosting that is fixedly installed at the suction side of the outdoor heat exchanger 8, a suction rotation portion 40 for defrosting that is rotatably coupled to the suction fixing portion 50 for defrosting, and a refrigerant inflow portion 31 for defrosting that connects the suction rotation portion 40 for defrosting and the second refrigerant flow path 10. However, embodiments of the present invention are not limited thereto, and the suction valve 30 for defrosting includes only the suction rotation portion 40 for defrosting so that the suction rotation portion 40 for defrosting can be rotatably coupled directly to the outdoor heat-exchanging flow paths 20. Also, the suction valve 30 for defrosting includes only the suction rotation portion 40 for defrosting and the suction fixing portion 50 for defrosting without the refrigerant inflow portion 31 for defrosting, so that the suction rotation portion 40 for defrosting can be connected directly to the second refrigerant flow path 10.

Figure 4:
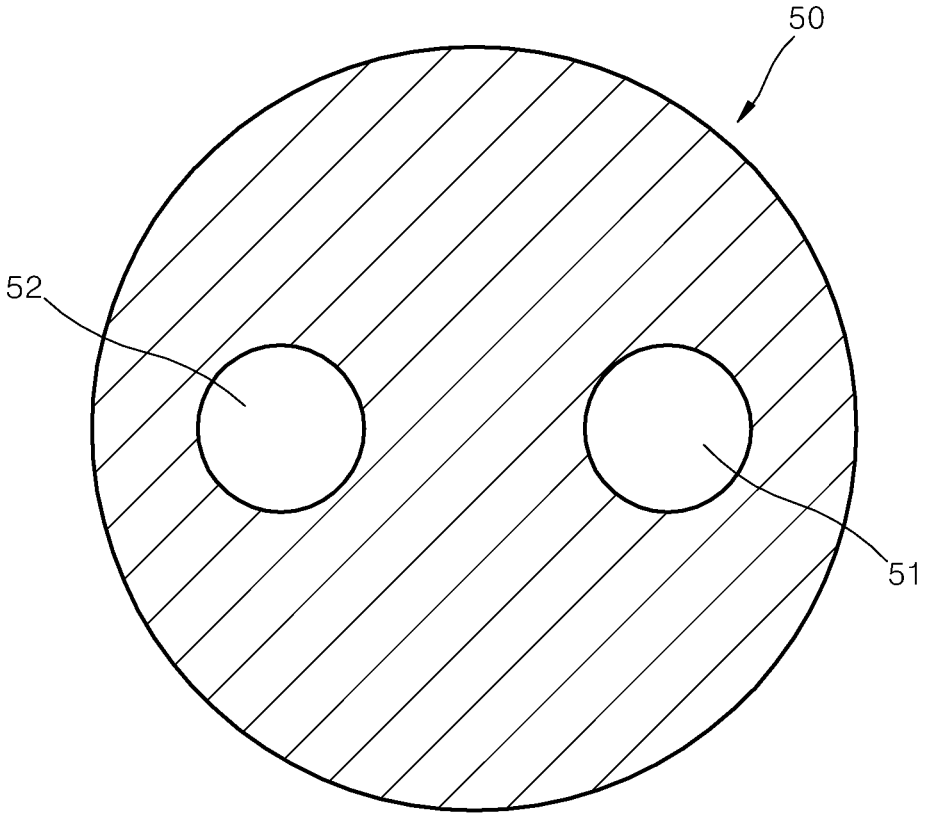
FIG. 4 is a cross-sectional view taken along line B-B of FIG. 2.

Referring to FIGS. 2 and 4, a plurality of suction fixing ports for defrosting are formed in the suction fixing portion 50 for defrosting so as to communicate with the plurality of outdoor heat-exchanging flow paths 20. The number of suction fixing ports for defrosting is set to be the same as the number of the outdoor heat-exchanging flow paths 20. Since, in the current embodiment, the outdoor heat-exchanging flow paths 20 include two outdoor heat-exchanging flow paths, the suction fixing ports for defrosting also include two, i.e., first and second suction fixing ports 51 and 52 for defrosting. Since the suction fixing portion 50 for defrosting is not rotated but is fixed, positions of the first and second suction fixing ports 51 and 52 for defrosting are not changed, and the first and second suction fixing ports 51 and 52 for defrosting are maintained to be connected to the first and second outdoor heat-exchanging flow paths 21 and 22, respectively.

The first suction fixing port 51 for defrosting is connected to the first outdoor heat-exchanging flow path 21 so as to communicate therewith. That is, the first suction fixing port 51 for defrosting is connected to a first suction flow path 171 for defrosting, and the first suction flow path 171 is connected to the first heat-exchanging suction flow path 151, and the first heat-exchanging suction flow path 151 is connected to the first outdoor heat-exchanging flow path 21.

The second suction fixing port 52 for defrosting is connected to the second outdoor heat-exchanging flow path 22 so as to communicate therewith. That is, the second suction fixing port 52 for defrosting is connected to the second suction flow path 172 for defrosting, and the second suction flow path 172 for defrosting is connected to the second heat-exchanging suction flow path 152, and the second heat-exchanging suction flow path 152 is connected to the second outdoor heat-exchanging flow path 22.

The first and second suction fixing ports 51 and 52 for defrosting are cylindrical holes each having a uniform cross-section.

Figure 3:
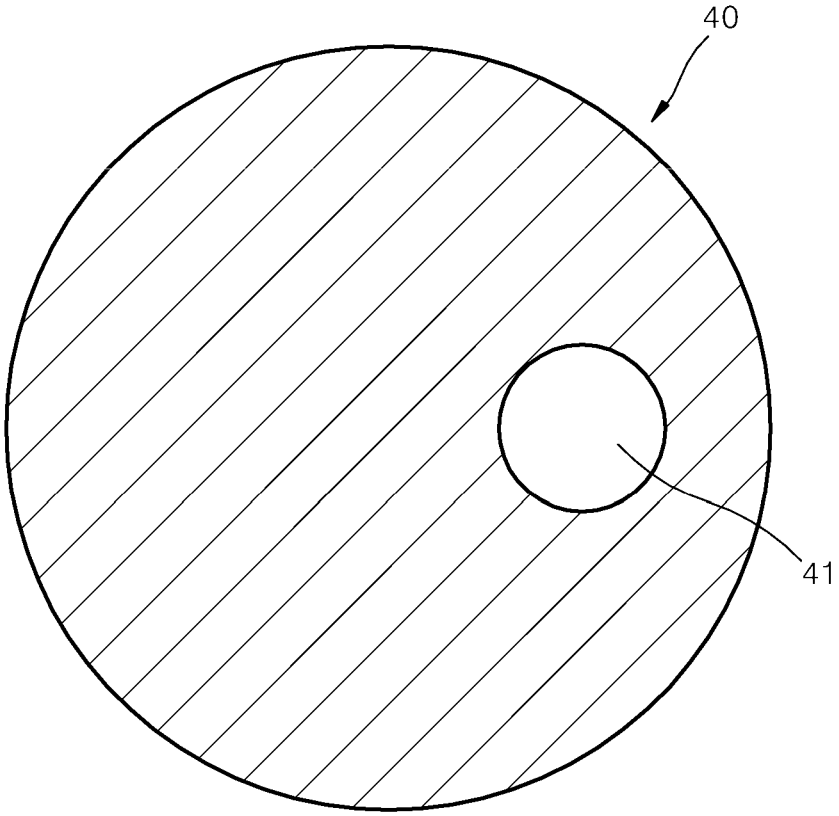
FIG. 3 is a cross-sectional view taken along line A-A of FIG. 2.

Referring to FIGS. 2 and 3, the suction rotation portion 40 for defrosting is rotatably coupled to the suction fixing portion 50 for defrosting, and a suction rotation port 41 for defrosting is formed in the suction rotation portion 40 for defrosting. The number of suction rotation ports 41 for defrosting is set to be smaller than the sum of numbers of the first and second suction fixing ports 51 and 52 for defrosting. Since, in the current embodiment, two, i.e., the first and second suction fixing ports 51 and 52 for defrosting are formed, the number of suction rotation ports 41 for defrosting is 1. Thus, the suction rotation port 41 for defrosting selectively communicates with one of the first and second suction fixing ports 51 and 52 for defrosting according to a rotation angle of the suction rotation portion 40 for defrosting. The suction rotation port 41 for defrosting is a cylindrical hole having a uniform cross-section.

The refrigerant inflow portion 31 for defrosting has a hollow shape and connects the second refrigerant flow path 10 and the suction rotation portion 40 for defrosting.

Figure 5:
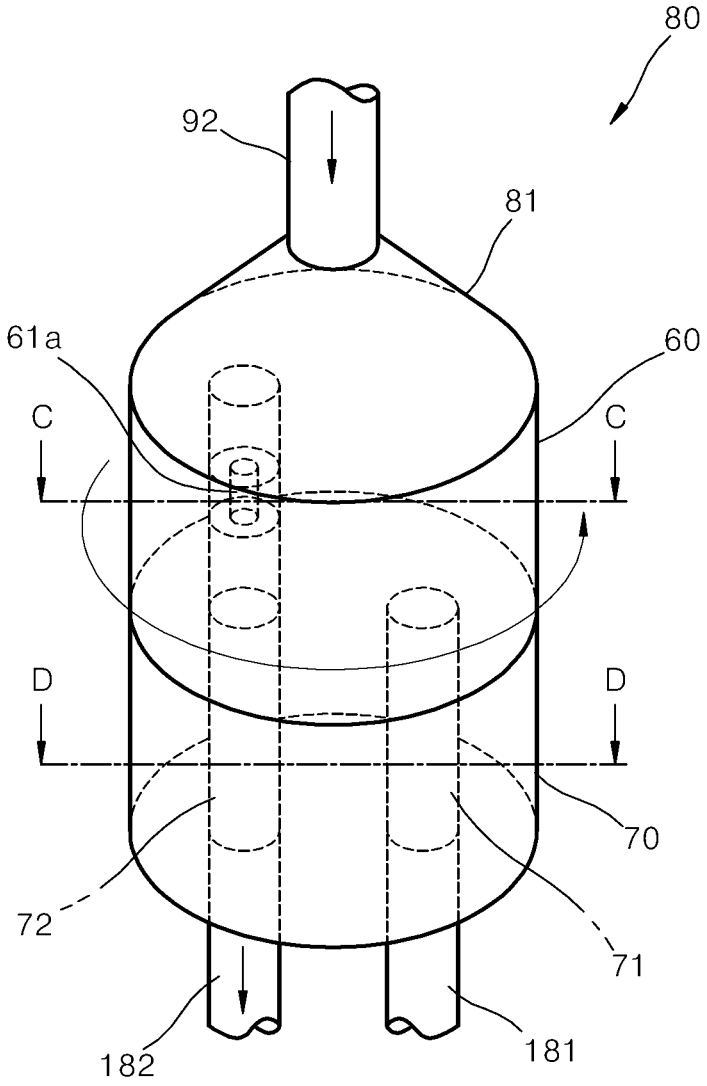
FIG. 5 is a view for describing a suction valve for evaporation illustrated in FIG. 1.

Referring to FIGS. 1 and 5, the suction valve 80 for evaporation is rotatably installed on a circulation flow path 92 on which the outlet of the outdoor heat exchanger 8 and the inlet of the outdoor heat exchanger 8 are connected to each other, so as to cause flow paths to communicate so that the refrigerant that passes through a flow path for defrosting of the first and second outdoor heat-exchanging flow paths 21 and 22 can be supplied to the flow path for evaporation.

Referring to FIG. 5, the suction valve 80 for evaporation includes a suction fixing portion 70 for evaporation that is fixedly installed at the suction side of the outdoor heat exchanger 8, a suction rotation portion 60 for evaporation that is rotatably coupled to the suction fixing portion 70 for evaporation, and a refrigerant inflow portion 81 for evaporation that connects the suction rotation portion 60 for evaporation and the circulation flow path 92. However, embodiments of the present invention are not limited thereto, and the suction valve 80 for evaporation may include only the suction rotation portion 60 for evaporation and may be connected directly to the outdoor heat-exchanging flow paths 20. Also, the suction valve 80 for evaporation may include only the suction rotation portion 60 for evaporation without the refrigerant inflow portion 81 for evaporation so that the suction rotation portion 60 for evaporation can be connected directly to the circulation flow path 92.

Figure 7:
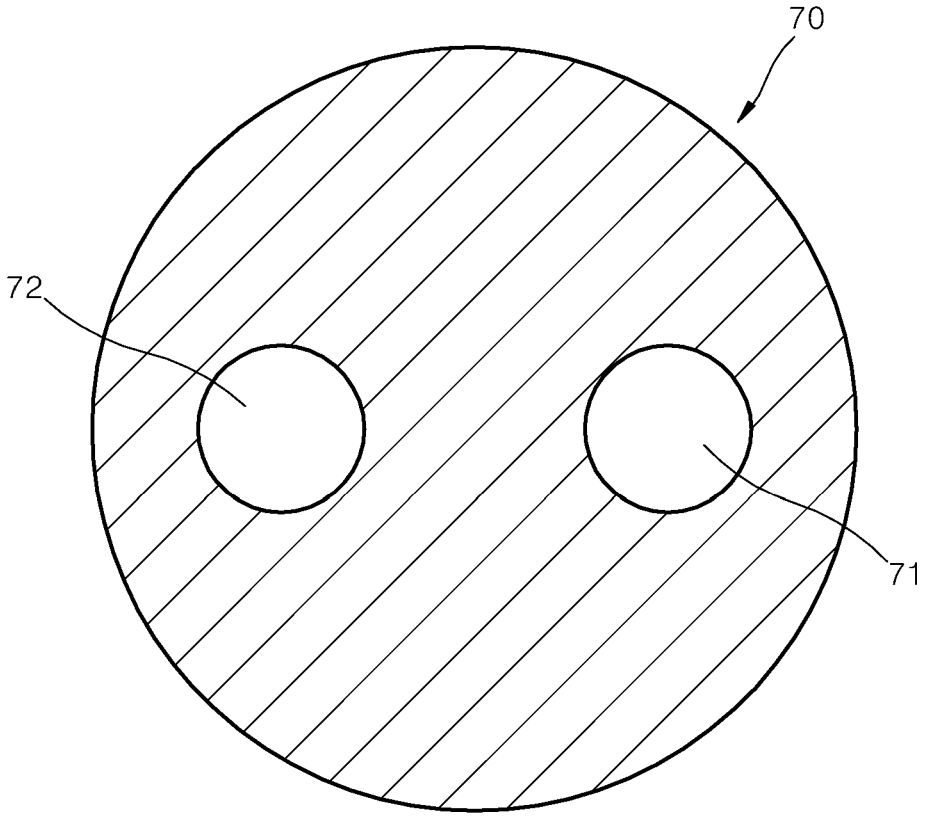
FIG. 7 is a cross-sectional view taken along line D-D of FIG. 5.

Referring to FIGS. 5 and 7, a plurality of suction fixing ports for evaporation are formed in the suction fixing portion 70 for evaporation. The number of the plurality of suction fixing ports for evaporation is set to be the same as the number of the outdoor heat-exchanging flow paths 20. Since, in the current embodiment, the outdoor heat-exchanging flow paths 20 include two, i.e., the first and second outdoor heat-exchanging flow paths 21 and 22, the suction fixing ports for evaporation also include two, i.e., first and second suction fixing ports 71 and 72 for evaporation.

The first suction fixing port 71 for evaporation is connected to the first outdoor heat-exchanging flow path 21 so as to communicate therewith. That is, the first suction fixing port 71 for evaporation is connected to a first suction flow path 181 for evaporation, and the first suction flow path 181 for evaporation is connected to the first outdoor heat-exchanging flow path 21 via the first heat-exchanging suction flow path 151.

The second suction fixing port 72 for evaporation is connected to the second outdoor heat-exchanging flow path 22 so as to communicate therewith. That is, the second suction fixing port 72 for evaporation is connected to the second suction flow path 182 for evaporation, and the second suction flow path 182 for evaporation is connected to the second outdoor heat-exchanging flow path 22 via the second heat-exchanging suction flow path 152.

The first and second suction fixing ports 71 and 72 for evaporation are cylindrical holes each having a uniform cross-section.

Figure 6:
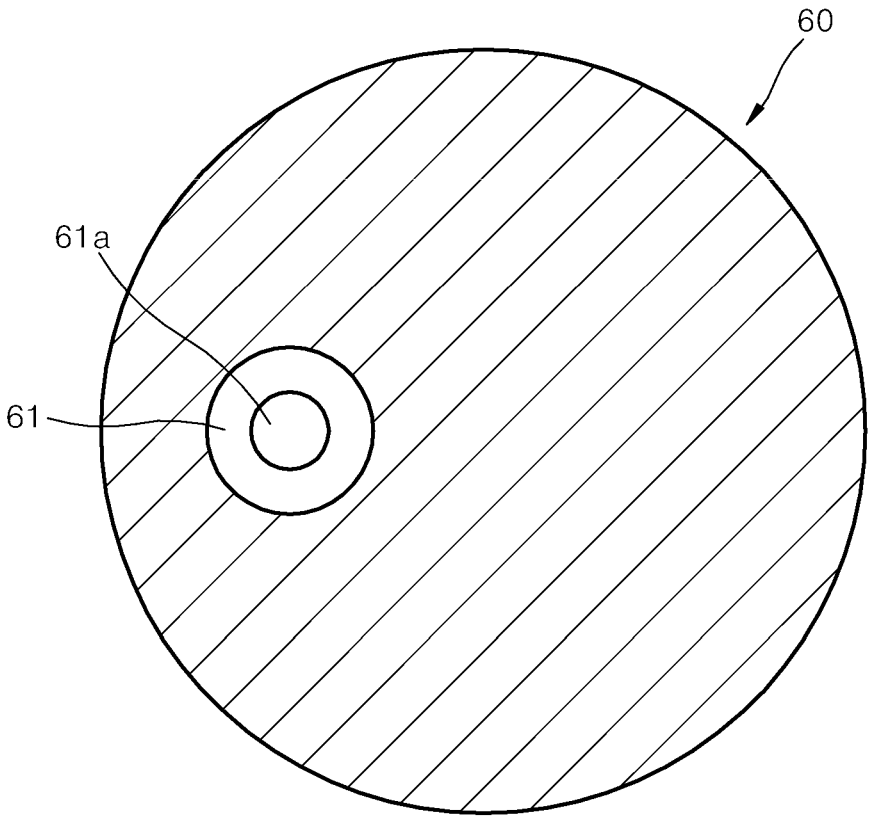
FIG. 6 is a cross-sectional view taken along line C-C of FIG. 5.

Referring to FIGS. 5 and 6, the suction rotation portion 60 for evaporation is rotatably coupled to the suction fixing portion 70 for evaporation, and a suction rotation port 61 for evaporation is formed in the suction rotation portion 60 for evaporation. The number of suction rotation ports 61 for evaporation is set to be smaller than the sum of numbers of the first and second suction fixing ports 71 and 72 for evaporation. Since, in the current embodiment, two, i.e., the first and second suction fixing ports 71 and 72 are formed, the number of suction rotation ports 61 for evaporation is 1. Thus, the suction rotation port 61 for evaporation selectively communicates with one of the first and second suction fixing ports 71 and 72 for evaporation according to a rotation angle of the suction rotation portion 60 for evaporation.

The suction rotation port 61 for evaporation is a cylindrical hole having a throttling structure 61*a* in which part of a cross-section becomes narrow.

The refrigerant inflow portion 81 for evaporation has a hollow shape and connects the circulation flow path 92 and the suction rotation portion 60 for evaporation.

Figure 8:
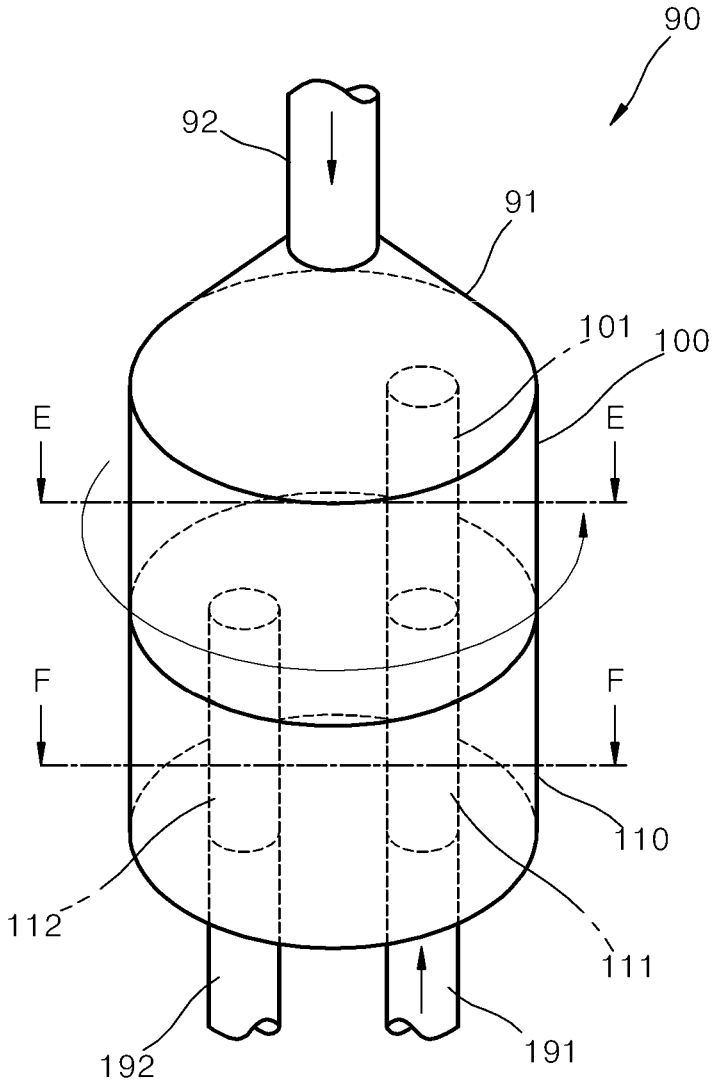
FIG. 8 is a view for describing a discharge valve for defrosting illustrated in FIG. 1.

Referring to FIGS. 1 and 8, the discharge valve 90 for defrosting is rotatably installed on the circulation flow path 92 on which the outlet of the outdoor heat exchanger 8 and an inlet of the suction valve 80 for evaporation are connected to each other. The discharge valve 90 for defrosting communicates flow paths so that the refrigerant that passes through the flow path for defrosting of the first and second outdoor heat-exchanging flow paths 21 and 22 can be supplied to the flow path for evaporation.

Referring to FIG. 8, the discharge valve 90 for defrosting includes a discharge fixing portion 110 for defrosting that is fixedly installed at an outlet side of the outdoor heat exchanger 8, a discharge rotation portion 100 for defrosting that is rotatably coupled to the discharge fixing portion 110 for defrosting, and a refrigerant discharge portion 91 for defrosting that connects the discharge rotation portion 100 for defrosting and the circulation flow path 92. However, embodiments of the present invention are not limited thereto, and the discharge valve 90 for defrosting includes only the discharge rotation portion 100 for defrosting and thus can also be connected directly to the outdoor heat-exchanging flow path 20. Also, the discharge valve 90 for defrosting may include only the discharge rotation portion 100 for defrosting without the refrigerant discharge portion 91 for defrosting so that the discharge rotation portion 100 for defrosting can be connected directly to the circulation flow path 92.

Figure 10:
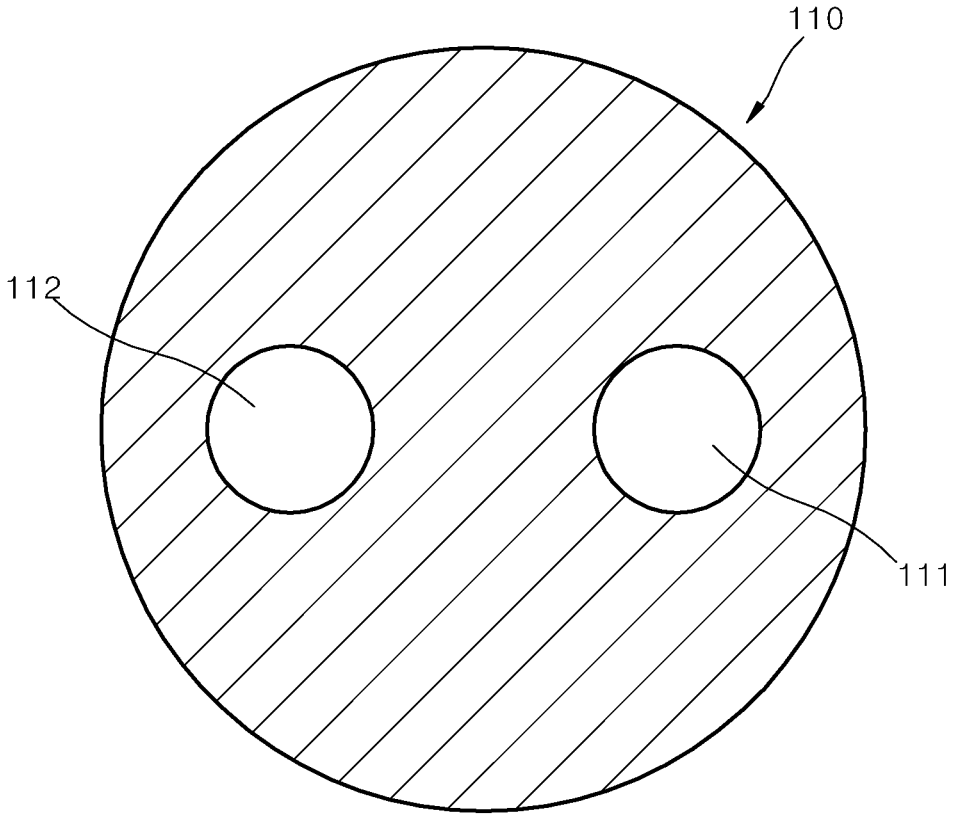
FIG. 10 is a cross-sectional view taken along line F-F of FIG. 8.

Referring to FIGS. 8 and 10, a plurality of discharge fixing ports for defrosting are formed in the discharge fixing portion 110 for defrosting. The number of the plurality of discharge fixing ports for defrosting is set to be the same as the number of outdoor heat-exchanging flow paths 20. Since, in the current embodiment, the outdoor heat-exchanging flow paths 20 include two, i.e., the first and second outdoor heat-exchanging flow paths 21 and 22, the discharge fixing ports for defrosting include two, i.e., first and second discharge fixing ports 111 and 112 for defrosting.

The first discharge fixing port 111 for defrosting is connected to the first outdoor heat-exchanging flow path 21 so as to communicate therewith. That is, the first discharge fixing port 111 for defrosting is connected to the first discharge flow path 191 for defrosting, and the first discharge flow path 191 for defrosting is connected to the first heat-exchanging discharge flow path 161. The second discharge fixing port 112 for defrosting is connected to the second outdoor heat-exchanging flow path 22 so as to communicate therewith. That is, the second discharge fixing port 112 for defrosting is connected to the second discharge flow path 192 for defrosting, and the second discharge flow path 192 for defrosting is connected to the second heat-exchanging discharge flow path 162.

The first and second discharge fixing ports 111 and 112 for defrosting are cylindrical holes each having a uniform cross-section.

Figure 9:
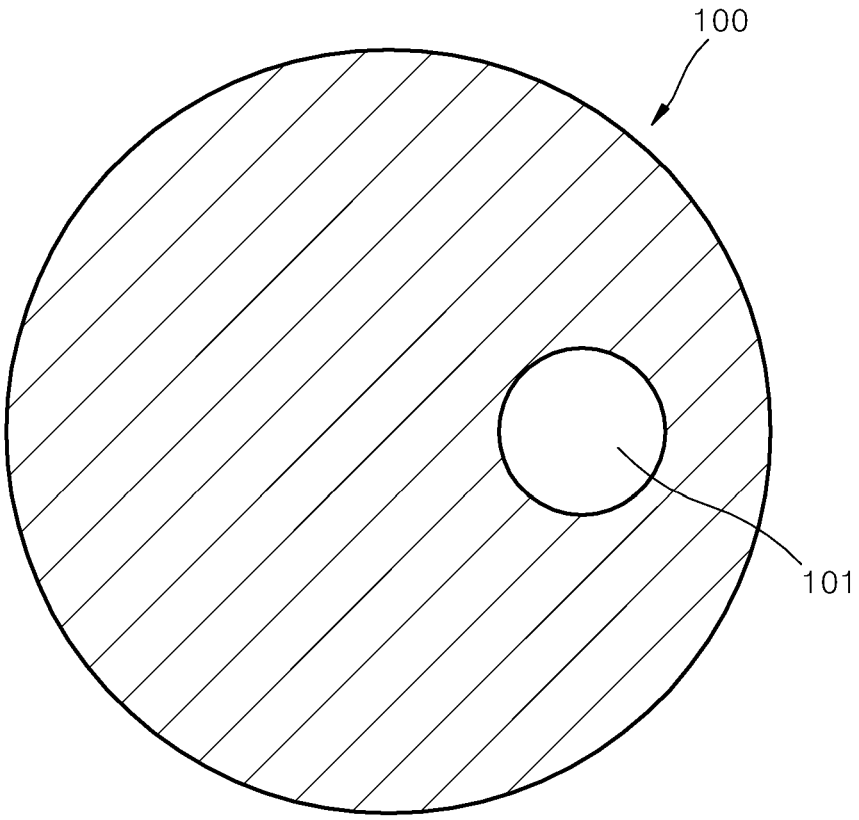
FIG. 9 is a cross-sectional view taken along line E-E of FIG. 8.

Referring to FIGS. 8 and 9, the discharge rotation portion 100 for defrosting is rotatably coupled to the discharge fixing portion 110 for defrosting, and a discharge rotation port 101 for defrosting is formed in the discharge rotation portion 100 for defrosting. The number of discharge rotation ports 101 for defrosting is set to be smaller than the sum of numbers of the first and second discharge fixing ports 111 and 112 for defrosting. Since, in the current embodiment, two, i.e., the first and second discharge fixing ports 111 and 112 are formed, the number of discharge rotation ports 101 for defrosting is 1. Thus, the discharge rotation port 101 for defrosting selectively communicates with one of the first and second discharge fixing ports 111 and 112 for defrosting according to a rotation angle of the discharge rotation portion 100 for defrosting.

The discharge rotation port 101 for defrosting is a cylindrical hole having a uniform cross-section.

The refrigerant discharge portion 91 for defrosting has a hollow shape and connects the circulation flow path 92 and the discharge rotation portion 100 for defrosting.

Figure 11:
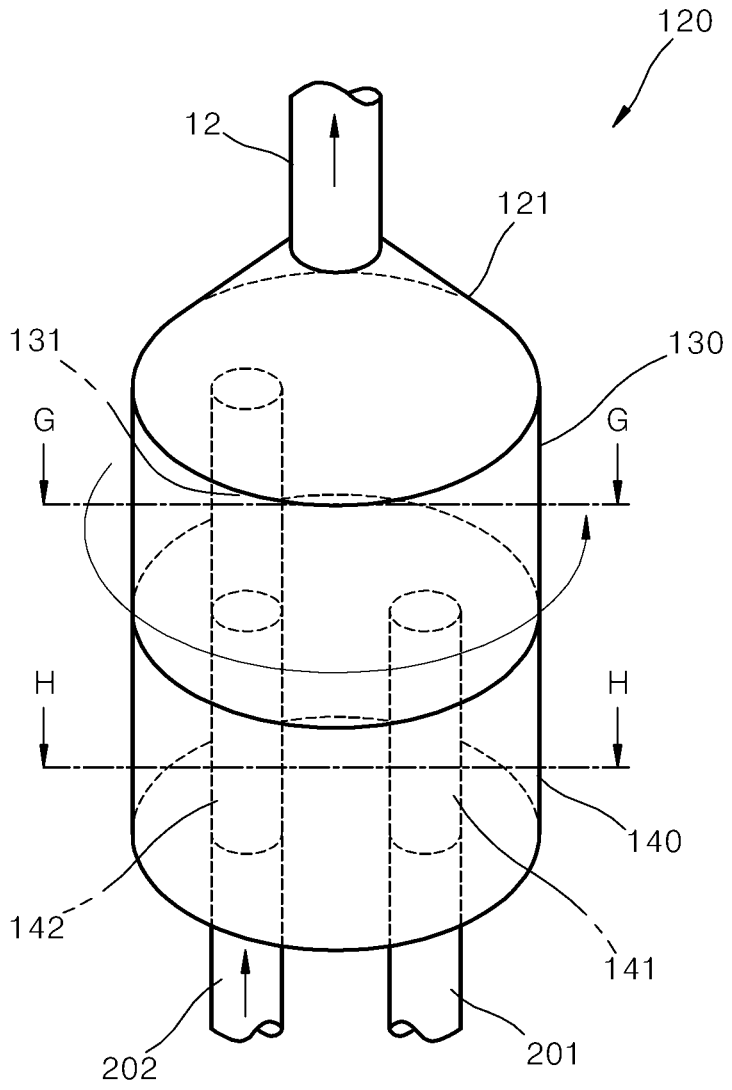
FIG. 11 is a view for describing a discharge valve for evaporation of FIG. 1.

Referring to FIGS. 1 and 11, the discharge valve 120 for evaporation is installed on the third refrigerant flow path 12 on which the outlet of the outdoor heat exchanger 8 and the inlet of the compressor 2 are connected to each other. The discharge valve 120 for evaporation communicates flow paths so that the refrigerant that passes through the flow path for evaporation of the first and second outdoor heat-exchanging flow paths 21 and 22 can be supplied to the compressor 2.

Referring to FIG. 11, the discharge valve 120 for evaporation includes a discharge fixing portion 140 for evaporation that is fixedly installed at an outlet of the outdoor heat exchanger 8, a discharge rotation portion 130 for evaporation that is rotatably coupled to the discharge fixing portion 140 for evaporation, and a refrigerant discharge portion 121 for evaporation that connects the discharge rotation portion 130 for evaporation and the third refrigerant flow path 12. However, embodiments of the present invention are not limited thereto, and the discharge valve 120 for evaporation includes only the discharge rotation portion 130 for evaporation and may also be connected directly to the outdoor heat-exchanging flow path 20. Also, the discharge valve 120 for evaporation may include only the discharge rotation portion 130 for evaporation without the refrigerant discharge portion 121 for evaporation so that the discharge rotation portion 130 for evaporation can be connected directly to the third refrigerant flow path 12.

Figure 13:
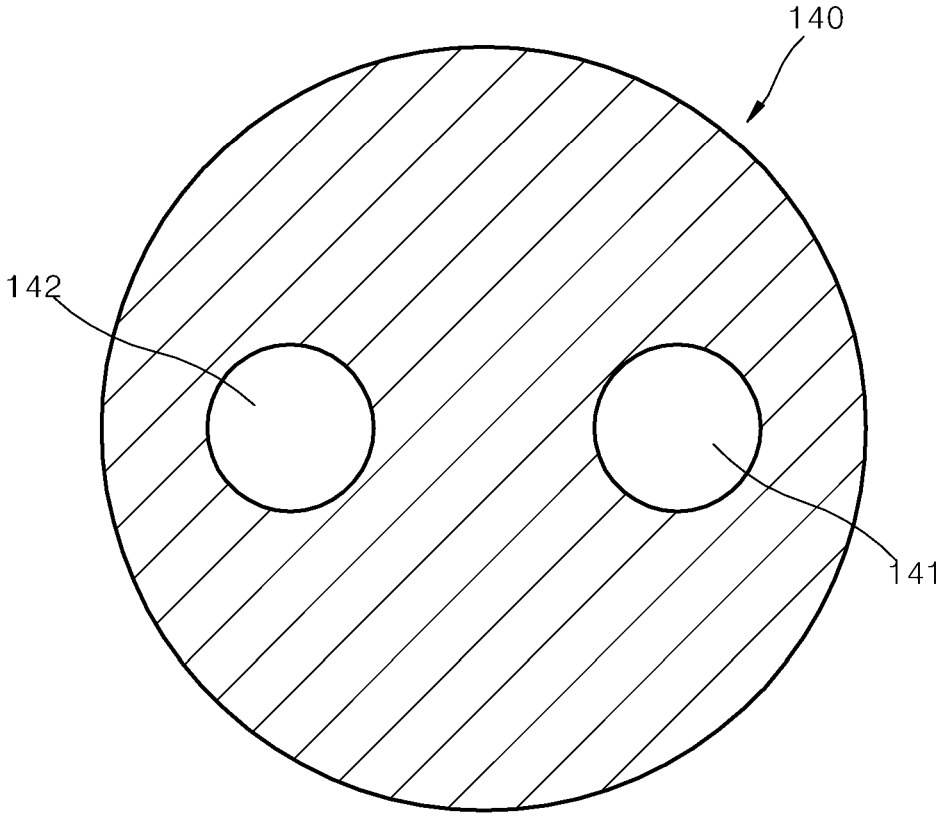
FIG. 13 is a cross-sectional view taken along line H-H of FIG. 11.

Referring to FIGS. 11 and 13, a plurality of discharge fixing ports for evaporation are formed in the discharge fixing portion 140 for evaporation. The number of the plurality of discharge fixing ports for evaporation is set to be the same as the number of the outdoor heat-exchanging flow paths 20. Since, in the current embodiment, the outdoor heat-exchanging flow paths 20 include two, i.e., the first and second outdoor heat-exchanging flow paths 21 and 22, the discharge fixing ports for evaporation also include two, i.e., first and second discharge fixing ports 141 and 142 for evaporation.

The first discharge fixing port 141 for evaporation is connected to the first outdoor heat-exchanging flow path 21 so as to communicate therewith. That is, the first discharge fixing port 141 for evaporation is connected to the first discharge flow path 201 for evaporation, and the first discharge flow path 201 for evaporation is connected to the first outdoor heat-exchanging flow path 21 via the first heat-exchanging discharge flow path 161.

The second discharge fixing port 142 for evaporation is connected to the second outdoor heat-exchanging flow path 22 so as to communicate therewith. That is, the second discharge fixing port 142 for evaporation is connected to the second discharge flow path 202 for evaporation, and the second discharge flow path 202 for evaporation is connected to the second outdoor heat-exchanging flow path 22 via the second heat-exchanging discharge flow path 162.

The first and second discharge fixing ports 141 and 142 for evaporation are cylindrical holes each having a uniform cross-section.

Figure 12:
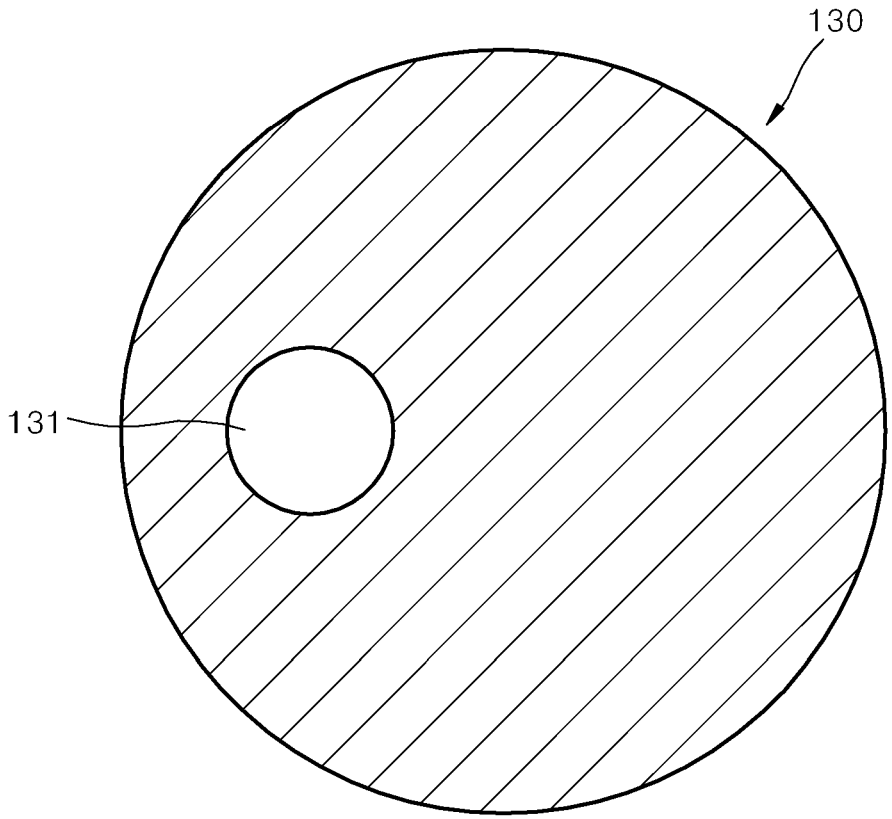
FIG. 12 is a cross-sectional view taken along line G-G of FIG. 11.

Referring to FIGS. 11 and 12, the discharge rotation portion 130 for evaporation is rotatably coupled to the discharge fixing portion 140 for evaporation, and a discharge rotation port 131 for evaporation is formed in the discharge rotation portion 130 for evaporation. The number of discharge rotation ports 131 for evaporation is set to be smaller than the sum of numbers of the first and second discharge fixing ports 141 and 142 for evaporation. Since, in the current embodiment, two, i.e., the first and second discharge fixing ports 141 and 142 for evaporation are formed, the number of discharge rotation ports 131 for evaporation is 1. Thus, the discharge rotation port 131 for evaporation selectively communicates with one of the first and second discharge fixing ports 141 and 142 for evaporation according to a rotation angle of the discharge rotation portion 130 for evaporation.

The first and second discharge fixing ports 141 and 142 for evaporation are cylindrical holes each having a uniform cross-section.

The refrigerant discharge portion 121 for evaporation has a hollow shape and connects the third refrigerant flow path 12 and the discharge rotation portion 130 for evaporation.

The flow path selection unit further includes a rotation unit (not shown) that together rotates the suction rotation portion 40 for defrosting of the suction valve 30 for defrosting, the suction rotation portion 60 for evaporation of the suction valve 30 for evaporation, the discharge rotation portion 100 for defrosting of the discharge valve 90 for defrosting, and the discharge rotation portion 130 for evaporation of the discharge valve 120 for evaporation and a controller (not shown) that controls an operation of the rotation unit.

An operation of the heat pump system having the above configuration illustrated in FIG. 1 will be described below.

The heat pump system can always simultaneously perform a defrosting operation and a heating operation in an extremely low-temperature district. That is, one of the first and second outdoor heat-exchanging flow paths 21 and 22 is used as a flow path for defrosting on which the defrosting operation is performed, and the other one thereof is used as a flow path for evaporation depending on selection of a flow path using the flow path selection unit.

The controller (not shown) rotates the suction rotation portion 40 for defrosting of the suction valve 30 for defrosting at a predetermined angle so as to communicate one suction rotation port 41 for defrosting with one of the first suction fixing port 51 for defrosting and the second suction fixing port 52 for defrosting. When the suction rotation port 41 for defrosting communicates with the first suction fixing port 51 for defrosting, the refrigerant condensed by the indoor heat exchanger 6 is supplied only to the first outdoor heat-exchanging flow path 21 and thus the first outdoor heat-exchanging flow path 21 is used as a flow path for defrosting. When the suction rotation port 41 for defrosting communicates with the second suction fixing port 52 for defrosting, the condensed refrigerant is supplied only to the second outdoor heat-exchanging flow path 22 and the second outdoor heat-exchanging flow path 22 is used as the flow path for defrosting.

First, a case where the first outdoor heat-exchanging flow path 21 of the first and second outdoor heat-exchanging flow paths 21 and 22 is used as the flow path for defrosting, will be described below with reference to FIG. 1.

As illustrated in FIGS. 1 and 2, when the suction rotation port 41 for defrosting communicates with the first suction fixing port 51 for defrosting, the refrigerant condensed by the indoor heat exchanger 6 is supplied to the first outdoor heat-exchanging flow path 21 via the suction rotation port 41 for defrosting and the first suction fixing port 51 for defrosting. In this case, since no throttling structure is formed in the suction rotation port 41 for defrosting and the first suction fixing port 51 for defrosting, a unthrottled refrigerant passes through the first outdoor heat-exchanging flow path 21. Thus, since the temperature of the refrigerant that passes through the first outdoor heat-exchanging flow path 21 is higher than the temperature of outdoor air, the refrigerant that passes through the first outdoor heat-exchanging flow path 21 is condensed, and condensation heat is supplied to outdoor air, and frost on the surface of the first outdoor heat-exchanging flow path 21 can be removed. In this case, the second suction fixing port 52 for defrosting is blocked by the suction rotation portion 40 for defrosting so that no refrigerant flows into the second suction fixing port 52 for defrosting.

The refrigerant in which a defrosting action is performed by passing through the first outdoor heat-exchanging flow path 21, is discharged through the first heat-exchanging discharge flow path 161. The refrigerant discharged through the first heat-exchanging discharge flow path 161 is supplied to one of the discharge valve 90 for defrosting and the discharge valve 120 for evaporation.

Since the refrigerant discharged through the first heat-exchanging discharge flow path 161 is a refrigerant in which the defrosting action is performed, the controller (not shown) causes the refrigerant discharged through the first heat-exchanging discharge flow path 161 to pass through the discharge valve 90 for defrosting. That is, the controller (not shown) rotates the discharge rotation portion 100 for defrosting of the discharge valve 90 for defrosting at a predetermined angle so as to cause the discharge rotation port 101 for defrosting to communicate with the first discharge fixing port 111 for defrosting. Thus, the refrigerant discharged through the first heat-exchanging discharge flow path 161 sequentially passes through the first discharge fixing port 111 for defrosting and the discharge rotation port 101 for defrosting and then flows into the suction valve 80 for evaporation.

The controller (not shown) rotates the suction rotation portion 60 for evaporation of the suction valve 80 for evaporation at a predetermined angle so as to cause one suction rotation port 61 for evaporation to communicate with one of the first and second suction fixing ports 71 and 72 for evaporation. Here, since the first outdoor heat-exchanging flow path 21 is used as a flow path for defrosting and the second outdoor heat-exchanging flow path 22 is used as a flow path for evaporation, the suction rotation port 61 for evaporation communicates with the second suction fixing port 72 for evaporation.

Thus, the refrigerant that flows into the suction valve 90 for evaporation passes through the throttling structure 61 of the suction rotation port 61 for evaporation and is throttled and then passes through the second suction fixing port 72 for evaporation. Since the second suction fixing port 72 for evaporation is connected to the second outdoor heat-exchanging flow path 22, the throttled refrigerant is supplied to the second outdoor heat-exchanging flow path 22. The refrigerant that passes through the second outdoor heat-exchanging flow path 22 is evaporated through heat-exchanging with outdoor air.

Thus, a defrosting action can be performed on the first outdoor heat-exchanging flow path 21, and an evaporation action can be performed on the second outdoor heat-exchanging flow path 22.

The refrigerant in which the evaporation action is performed by passing through the second outdoor heat-exchanging flow path 22, is discharged through the second heat-exchanging flow path 162. The refrigerant discharged through the second heat-exchanging flow path 162 is supplied to one of the discharge valve 90 for defrosting and the discharge valve 120 for evaporation.

Since the refrigerant discharged through the second heat-exchanging discharge flow path 162 is a refrigerant in which the evaporation action is performed, the controller (not shown) causes the refrigerant discharged through the second heat-exchanging discharge flow path 162 to pass through the discharge valve 120 for evaporation. That is, the controller (not shown) rotates the discharge rotation portion 130 for evaporation of the discharge valve 120 for evaporation at a predetermined angle so as to cause the discharge rotation port 131 for evaporation to communicate with the second discharge fixing port 142 for evaporation. Thus, the refrigerant discharged through the second outdoor heat-exchanging flow path 22 sequentially passes through the second discharge fixing port 142 for evaporation and the discharge rotation port 131 for evaporation and then is supplied to the compressor 2.

Figure 14:
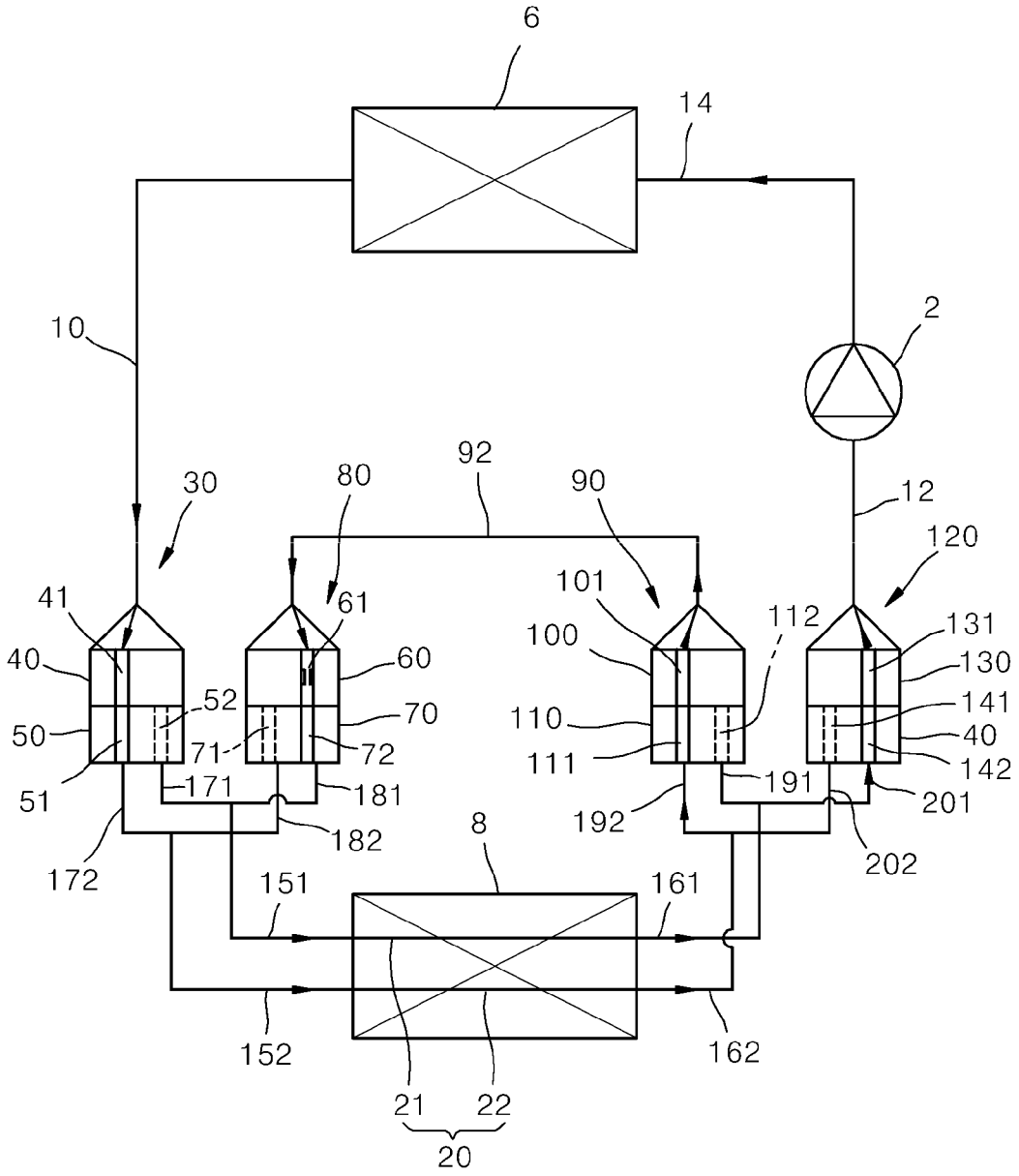
FIG. 14 is a view for describing a configuration of a flow of the refrigerant when a defrosting action is performed on a second outdoor heat-exchanging flow path of the heat pump system illustrated in FIG. 1.

A case where, after the defrosting action is performed on the first outdoor heat-exchanging flow path 21, the second outdoor heat-exchanging flow path 22 is used as a flow path for defrosting and the first outdoor heat-exchanging flow path 21 is used as a flow path for evaporation, will be described below with reference to FIG. 14.

Figure 15:
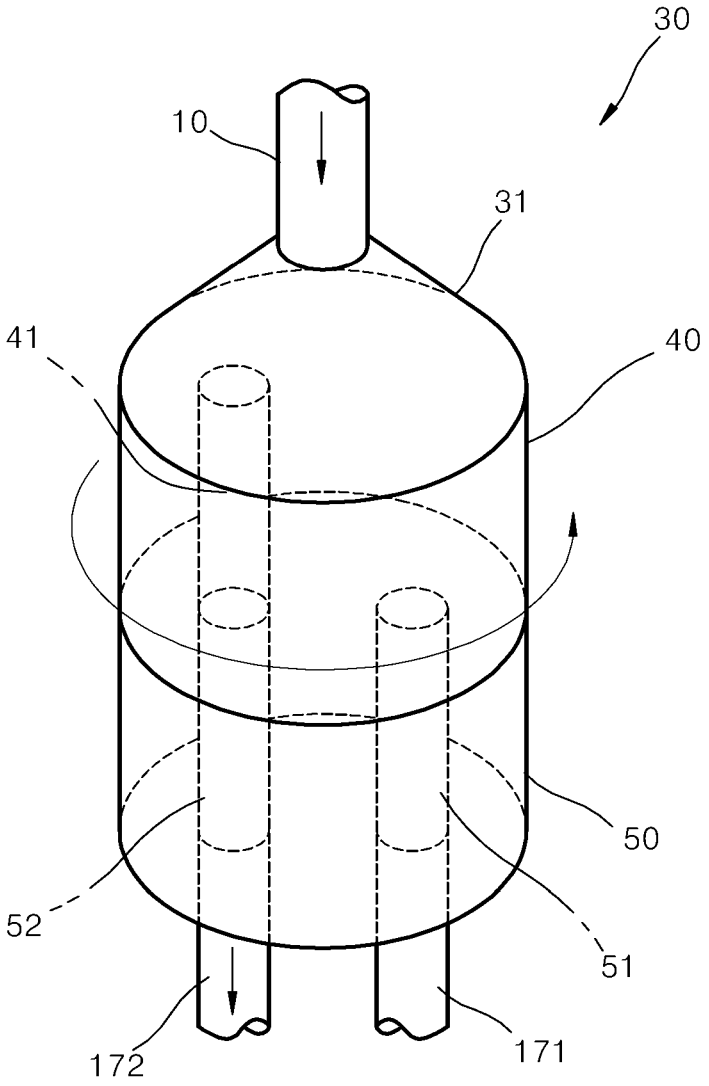
FIG. 15 is a view for describing a suction valve for defrosting illustrated in FIG. 14.

Referring to FIG. 15, the controller (not shown) rotates the suction rotation portion 40 for defrosting of the suction valve 30 for defrosting at a predetermined angle so as to cause the suction rotation port 41 for defrosting to communicate with the second suction fixing port 42 for defrosting.

When the suction rotation port 41 for defrosting communicates with the second suction fixing port 42 for defrosting, the refrigerant condensed by the indoor heat exchanger 6 is supplied to the second outdoor heat-exchanging flow path 22 via the second suction fixing port 42 for defrosting.

The refrigerant supplied to the second outdoor heat-exchanging flow path 22 is condensed through heat-exchanging with outdoor air so that frost on the surface of the second outdoor heat-exchanging flow path 22 can be removed.

The refrigerant in which the defrosting action is formed, on the second outdoor heat-exchanging flow path 22, is discharged through the second heat-exchanging discharge flow path 162 and then is supplied to the discharge valve 90 for defrosting.

Figure 17:
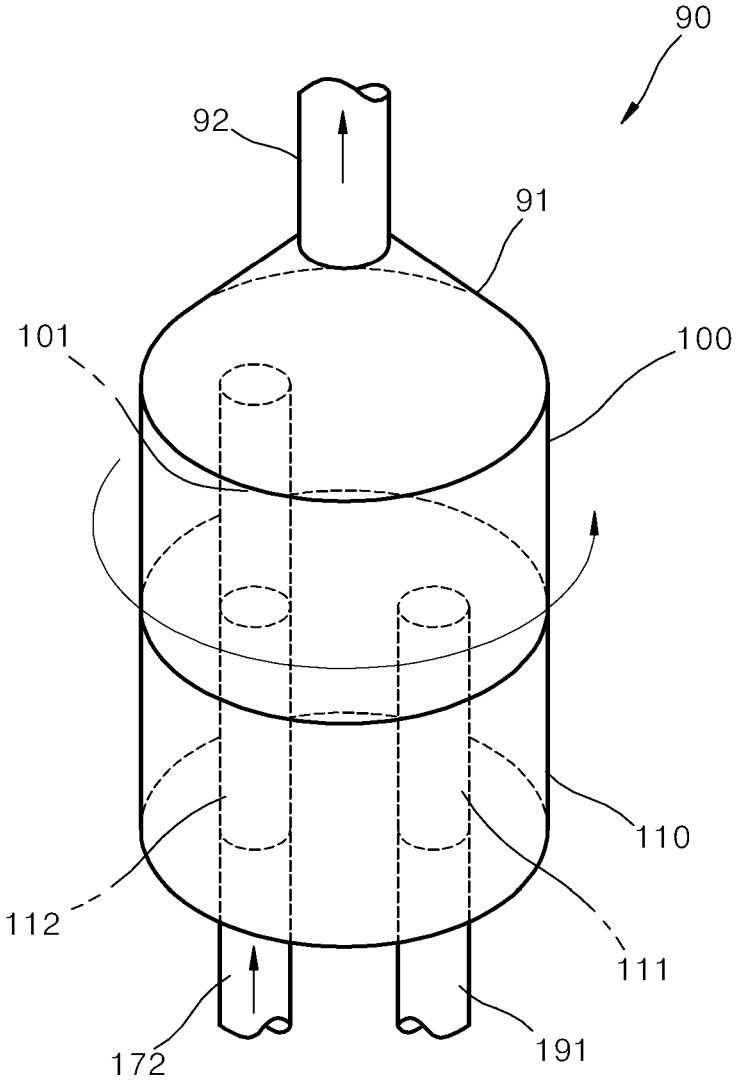
FIG. 17 is a view for describing a discharge valve for defrosting of FIG. 14.

Referring to FIG. 17, the controller (not shown) rotates the discharge rotation portion 100 for defrosting of the discharge valve 90 for defrosting at a predetermined angle so as to cause the discharge rotation port 101 for defrosting to communicate with the second discharge fixing port 112 for defrosting.

When the second discharge fixing port 112 for defrosting communicates with the discharge rotation port 101 for defrosting, the refrigerant discharged through the second heat-exchanging discharge flow path 162 is supplied to the suction valve 80 for evaporation via the discharge valve 30 for defrosting.

Figure 16:
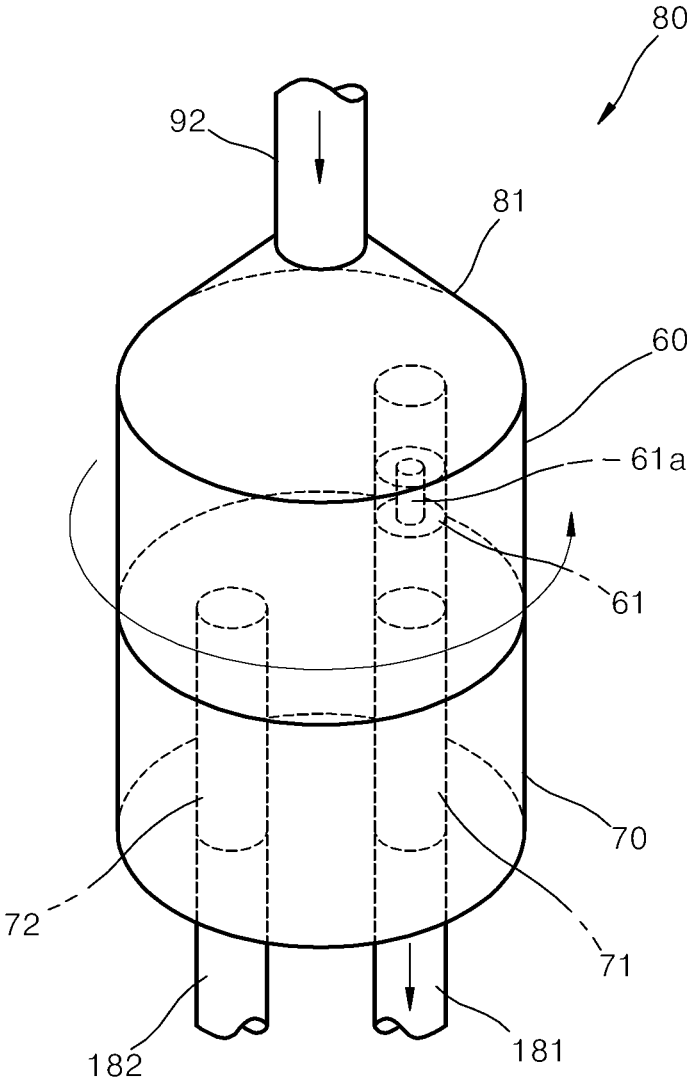
FIG. 16 is a view for describing a suction valve for evaporation illustrated in FIG. 14.

Referring to FIG. 16, the controller (not shown) rotates the suction rotation portion 60 for evaporation of the suction valve 80 for evaporation at a predetermined angle so as to cause the suction rotation port 61 for evaporation to communicate with the first suction fixing port 71 for evaporation.

When the suction rotation port 61 for evaporation communicates with the first suction fixing port 71 for evaporation, the refrigerant that is throttled by passing through the suction rotation port 61 for evaporation is supplied to the first outdoor heat-exchanging flow path 21 via the first suction fixing port 71 for evaporation.

The refrigerant supplied to the first outdoor heat-exchanging flow path 21 is evaporated through heat-exchanging with outdoor air.

Thus, while the second outdoor heat-exchanging flow path 22 is used as a flow path for defrosting, the first outdoor heat-exchanging flow path 21 may be used as a flow path for evaporation.

The refrigerant evaporated on the first outdoor heat-exchanging flow path 21 is discharged through the first heat-exchanging discharge flow path 161.

Figure 18:
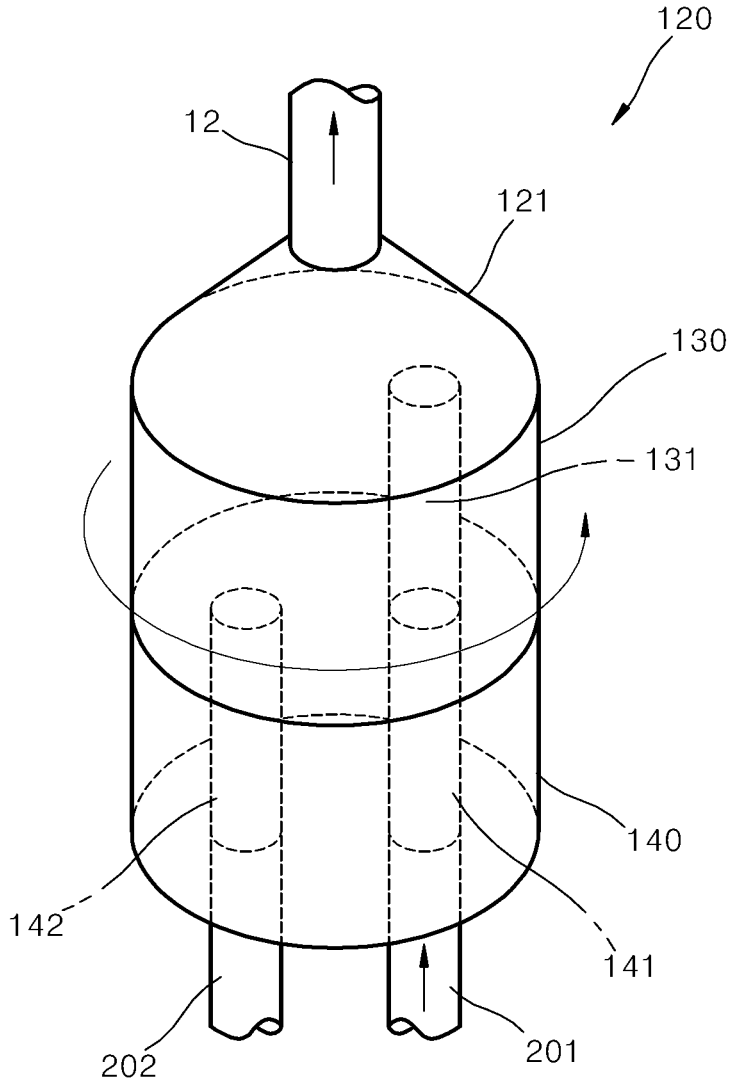
FIG. 18 is a view for describing a discharge valve for evaporation of FIG. 14.

Referring to FIG. 18, the controller (not shown) rotates the discharge rotation portion 130 for evaporation of the discharge valve 120 for evaporation at a predetermined angle so as to cause the discharge rotation port 131 for evaporation to communicate with the first discharge fixing ports 141 for evaporation.

Thus, the refrigerant discharged through the first heat-exchanging discharge flow path 161 may pass through the first discharge fixing ports 141 for evaporation and the discharge rotation port 131 for evaporation and then may be supplied to the compressor 2.

As described above, one of the first and second outdoor heat-exchanging flow paths 21 and 22 is used as a flow path for defrosting, and the other one thereof is used as a flow path for evaporation so that defrosting and heating can be simultaneously performed.

Also, the first and second outdoor heat-exchanging flow paths 21 and 22 can be alternately used as a flow path for defrosting using the flow path selection unit.

As described above, in an embodiment (FIG. 1) of the present invention, outdoor heat-exchanging flow paths include two outdoor heat-exchanging flow paths. However, when outdoor heat-exchanging flow paths include two or more outdoor heat-exchanging flow paths, two or more outdoor heat-exchanging flow paths may be used as flow paths for defrosting, and the other outdoor heat-exchanging flow paths may be used as flow paths for evaporation.

Figure 19:
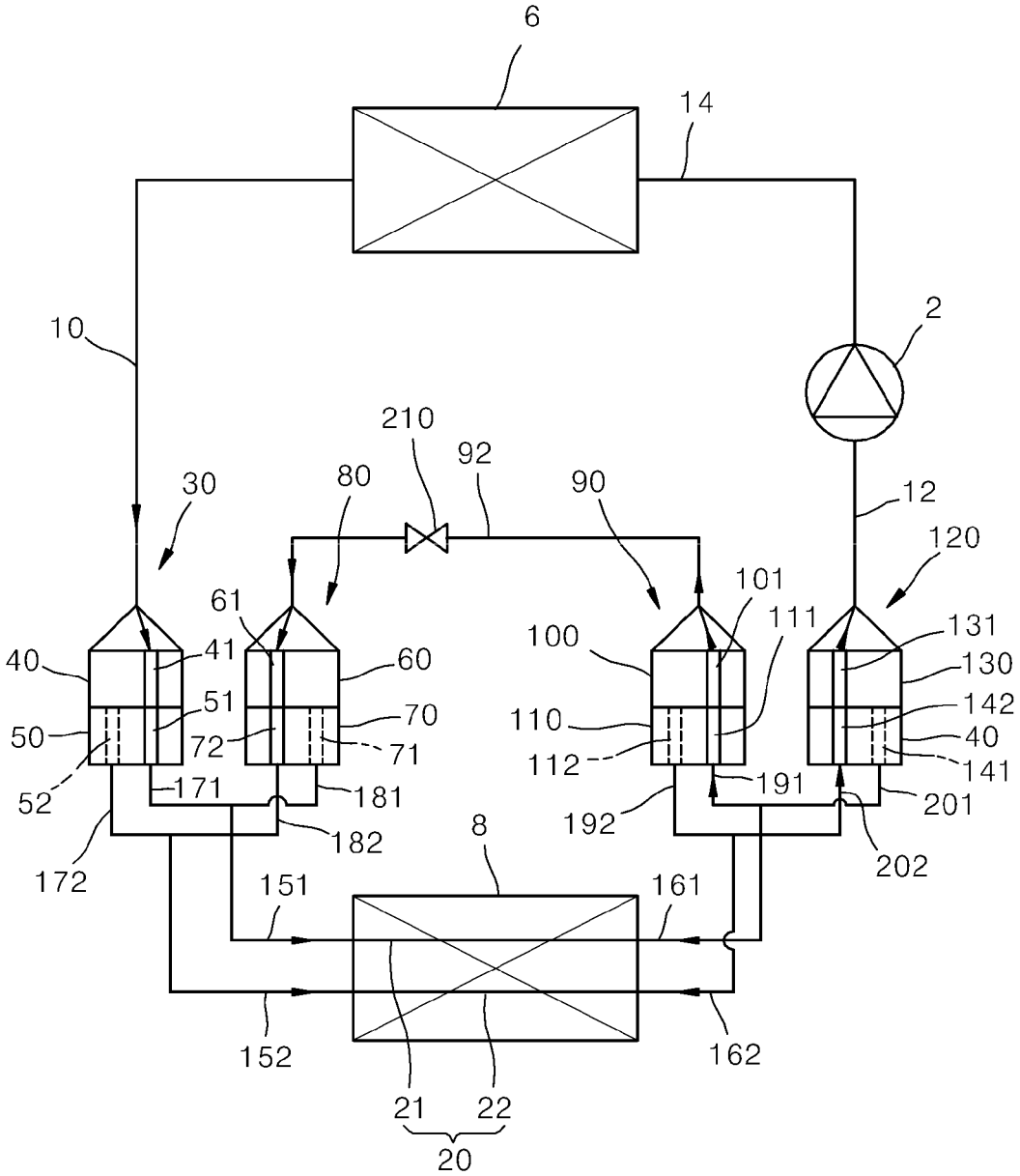
FIG. 19 is a view for describing a configuration of a heat pump system according to another embodiment of the present invention.

Referring to FIG. 19, a heat pump system according to another embodiment of the present invention is different from the heat pump system according to an embodiment (FIG. 1) of the present invention in that a throttling valve 210 that throttles a refrigerant is installed on the circulation flow path 92 and no throttling structure is formed in a suction rotation port 61 for evaporation of the suction valve 80 for evaporation.

The suction rotation port 61 for evaporation has a cylindrical shape in which a cross-section of the suction rotation port for evaporation is uniform.

Thus, the refrigerant in which a defrosting action is performed on the first outdoor heat-exchanging flow path 21 through the suction valve 30 for defrosting and which passes through the discharge valve 90 for evaporation, is throttled on the throttling valve 210 of the circulation flow path 92.

The refrigerant throttled by the throttling valve 210 passes through the suction rotation port 61 for evaporation of the suction valve 80 for evaporation and flows into the second outdoor heat-exchanging flow path 22 and is evaporated.

As described above, before the refrigerant flows into the outdoor heat exchanger 8, the refrigerant that is used to defrost the outdoor heat exchanger 8 may be throttled on the suction valve 80 for evaporation, like in FIG. 1 and may be throttled on the circulation flow path 91, like in FIG. 19.

As described above, in a heat pump system according to the present invention, at least part of a plurality of outdoor heat-exchanging flow paths that pass through an outdoor heat exchanger is alternately selected as and used as a flow path for defrosting, and the other flow path is used as a flow path for evaporation so that defrosting and a heating operation can be simultaneously performed.

In addition, a suction valve is rotatably installed at a suction side of the outdoor heat exchanger so that a flow path can be selected using the suction valve. Thus, the heat pump system according to the present invention can be used without adding or changing a refrigerant flow path, and a structure of the heat pump system is simple, and the plurality of outdoor heat-exchanging flow paths can be alternately selected and defrosted.

Furthermore, the refrigerant in which a defrosting action is performed by passing through the outdoor heat exchanger, is throttled and then is used for an evaporation action so that the structure of the heat pump system is simple and both heating and defrosting can be performed.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A heat pump system comprising:

a compressor;

an indoor heat exchanger;

an outdoor heat exchanger;

a plurality of outdoor heat-exchanging flow paths that are formed to pass through the outdoor heat exchanger and that heat-exchange a refrigerant flowing into the outdoor heat exchanger with outdoor air; and a flow path selection unit that alternately selects at least part of the plurality of outdoor heat-exchanging flow paths as a first flow path for defrosting and supplies the refrigerant condensed by the indoor heat exchanger to the first flow path for defrosting so that a defrosting action is capable of being performed and that selects the other flow path than the first flow path for defrosting as a second flow path for evaporation and that throttles the refrigerant discharged after the defrosting action is performed and then supplies the throttled refrigerant to the second flow path for evaporation so that an evaporation action is capable of being performed, wherein the flow path selection unit comprises a suction valve for defrosting which is rotatably installed on a flow path on which an outlet of the indoor heat exchanger and an inlet of the outdoor heat exchanger are connected to each other, and which includes a suction rotation port for defrosting that is configured to supply the refrigerant condensed by the indoor heat exchanger to the flow path for defrosting, wherein the suction valve for defrosting comprises:

a fixing portion which is fixedly installed at a suction side of the outdoor heat exchanger and in which a plurality of suction fixing ports for defrosting are formed to communicate with the plurality of outdoor heat-exchanging flow paths, respectively; and a rotation portion which is rotatably coupled to the fixing portion and in which the suction rotation port for defrosting selectively communicates with at least part of the plurality of suction fixing ports for defrosting according to a rotation angle of the rotation portion.

2. The heat pump system of claim 1, wherein the flow path selection unit comprises a discharge valve for evaporation which is rotatably installed on a flow path on which the outlet of the outdoor heat exchanger and an inlet of the compressor are connected to each other, and which includes a discharge rotation port for evaporation that is configured to supply the refrigerant passing through the second flow path for evaporation to the compressor.

3. The heat pump system of claim 2, wherein the discharge valve for evaporation comprises:

a fixing portion which is fixedly installed at the outlet side of the outdoor heat exchanger and in which a plurality of discharge fixing ports for evaporation are formed to communicate with the plurality of outdoor heat-exchanging flow paths, respectively; and a rotation portion which is rotatably coupled to the fixing portion and in which a discharge rotation port for evaporation is formed to selectively communicate with at least part of the plurality of discharge fixing ports for evaporation according to a rotation angle of the rotation portion.

4. A heat pump system comprising:

a compressor;

an indoor heat exchanger;

an outdoor heat exchanger;

a plurality of outdoor heat-exchanging flow paths that are formed to pass through the outdoor heat exchanger and that heat-exchange a refrigerant flowing into the outdoor heat exchanger with outdoor air; and a flow path selection unit that alternately selects at least part of the plurality of outdoor heat-exchanging flow paths as a first flow path for defrosting and supplies the refrigerant condensed by the indoor heat exchanger to the first flow path for defrosting so that a defrosting action is capable of being performed and that selects the other flow path than the first flow path for defrosting as a second flow path for evaporation and that throttles the refrigerant discharged after the defrosting action is performed and then supplies the throttled refrigerant to the second flow path for evaporation so that an evaporation action is capable of being performed, wherein the flow path selection unit comprises a suction valve for evaporation which is rotatably installed on a flow path on which an outlet of the outdoor heat exchanger and an inlet of the outdoor heat exchanger are connected to each other, and which includes a suction rotation port for evaporation that is configured to supply the refrigerant passing through the first flow path for defrosting to the second flow path for evaporation.

5. The heat pump system of claim 4, wherein a throttling structure in which the refrigerant is throttled, is formed in the suction rotation port for evaporation.

6. The heat pump system of claim 4, further comprising a throttling valve that is installed on a flow path on which the outlet of the outdoor heat exchanger and the inlet of the outdoor heat exchanger are connected to each other.

7. The heat pump system of claim 4, wherein the suction valve for evaporation comprises:

a fixing portion which is fixedly installed at a suction side of the outdoor heat exchanger and in which a plurality of suction fixing ports for evaporation are formed to communicate with the plurality of outdoor heat-exchanging flow paths, respectively; and a rotation portion which is rotatably coupled to the fixing portion and in which the suction rotation port for evaporation selectively communicates with at least part of the plurality of suction fixing ports for evaporation according to a rotation angle of the rotation portion.

8. The heat pump system of claim 4, wherein the flow path selection unit comprises a discharge valve for defrosting which is rotatably installed on a flow path on which the outlet of the outdoor heat exchanger and an inlet of the suction valve for evaporation are connected to each other, and which includes a discharge rotation port for defrosting that is configured to supply the refrigerant passing through the first flow path for defrosting to the suction valve for evaporation.

9. The heat pump system of claim 8, wherein the discharge valve for defrosting comprises:

a fixing portion which is fixedly installed at an outlet side of the outdoor heat exchanger and in which a plurality of discharge fixing ports for defrosting are formed to communicate with the plurality of outdoor heat-exchanging flow paths, respectively; and a rotation portion which is rotatably coupled to the fixing portion and in which a discharge rotation port for defrosting is formed to selectively communicate with at least part of the plurality of discharge fixing ports for defrosting according to a rotation angle of the rotation portion.

10. A heat pump system comprising:

a compressor;

an indoor heat exchanger;

an outdoor heat exchanger;

a plurality of outdoor heat-exchanging flow paths that are formed to pass through the outdoor heat exchanger and that heat-exchange a refrigerant flowing into the outdoor heat exchanger with outdoor air;

a suction valve for defrosting that is rotatably installed between an outlet of the indoor heat exchanger and an inlet of the outdoor heat exchanger, selects a flow path for defrosting of the plurality of outdoor heat-exchanging flow paths according to a rotation angle and supplies the refrigerant condensed by the indoor heat exchanger to the flow path for defrosting;

a suction valve for evaporation that is rotatably installed on a flow path on which the outlet of the outdoor heat exchanger and the inlet of the outdoor heat exchanger are connected to each other, selects the other flow path than the flow path for defrosting of the outdoor heat-exchanging flow paths as a flow path for evaporation, throttles the refrigerant discharged after a defrosting action is performed on the outdoor heat exchanger and then supplies the throttled refrigerant to the flow path for evaporation;

a discharge valve for defrosting that is rotatably installed on a flow path on which the outlet of the outdoor heat exchanger and the inlet of the suction valve for evaporation are connected to each other, and that supplies the refrigerant discharged on the flow path for defrosting of the outdoor heat-exchanging flow paths to the suction valve for evaporation according to a rotation angle;

a discharge valve for evaporation that is rotatably installed on a flow path on which the outlet of the outdoor heat exchanger and the inlet of the compressor are connected to each other, and that supplies the refrigerant discharged on the flow path for evaporation of the outdoor heat-exchanging flow paths to the compressor according to a rotation angle; and a rotation unit that rotates the suction valve for defrosting, the suction valve for evaporation, the discharge valve for defrosting and the discharge valve for evaporation.

* * * * *